United States Patent [19]

Sawada et al.

[11] Patent Number: 4,697,567

[45] Date of Patent: Oct. 6, 1987

[54] AIR-FUEL RATIO CONTROL SYSTEM OF INTERNAL COMBUSTION ENGINE

[75] Inventors: Hiroshi Sawada, Gotemba; Toshimi Murai, Susono, both of Japan

[73] Assignee: Toyota Jidosha Kabushiki Kaisha, Toyota, Japan

[21] Appl. No.: 772,888

[22] Filed: Sep. 5, 1985

[30] Foreign Application Priority Data

Sep. 6, 1984 [JP] Japan ..... 59-187557

[51] Int. Cl.[4] ..... F02D 41/12

[52] U.S. Cl. ..... 123/489; 123/493

[58] Field of Search ..... 123/440, 489, 493, 325, 123/326

[56] References Cited

U.S. PATENT DOCUMENTS

| | | | |
|---|---|---|---|
| 4,282,842 | 8/1981 | Sasayama | 123/440 |
| 4,311,123 | 1/1982 | Glockler et al. | 123/493 X |
| 4,502,448 | 3/1985 | Otobe | 123/493 X |
| 4,527,521 | 7/1985 | Hasegawa et al. | 123/493 X |

FOREIGN PATENT DOCUMENTS

| | | | |
|---|---|---|---|
| 155549 | 9/1984 | Japan | 123/489 |

*Primary Examiner*—Tony M. Argenbright

*Attorney, Agent, or Firm*—Cushman, Darby & Cushman

[57] ABSTRACT

An air-fuel ratio control system for an internal combustion engine. Excessive fuel supplying at fuel cut reset time is avoided, by interrupting the fuel supply when a fuel cut control signal is being output. An amount of fuel cut time during which the fuel cut control signal is output is determined, and a hold time is also determined. This hold time corresponds to an amount of time necessary for combustion gas to reach a feedback sensor, and be included in the feedback control signal, after termination of the fuel cut. A feedback or closed loop system is used during normal operations. An open loop control signal is used during fuel cut time, and for a period of time equivalent to the value of the hold time after the end of this fuel cut time. Therefore, open loop control is used until exhaust gases have again reached the feedback sensor so that feedback or closed loop control can thereafter be used.

17 Claims, 7 Drawing Figures

AIR-FUEL RATIO CONTROL SYSTEM OF INTERNAL COMBUSTION ENGINE

BACKGROUND OF THE INVENTION

1. Field of the Invention

The present invention relates to an air-fuel ratio control system of an internal combustion engine. More specifically, the invention relates to an air-fuel ratio control system of an internal combustion engine wherein excessive fuel supply at fuel cut reset time is prevented.

2. Description of the Prior Art

In an air-fuel ratio control system of an electronic control internal combustion engine in the prior art, air-fuel ratio control of the fuel cut reset time is started on the basis of output of an oxygen sensor just after the fuel cut reset. Thereby the optimum state of the air-fuel ratio is secured.

As a matter of fact, however, a time lag naturally exists before detecting the air-fuel ratio in the combustion chamber. Consequently, the oxygen sensor generates a lean mixture signal on the basis of a value which includes the time lag. That is, since a certain time is required after leaving of the combustion gas from the combustion chamber to its reaching the oxygen sensor, the oxygen sensor detects a gas containing a fuel scarcely at the fuel cut reset time and therefore generates the lean mixture signal. Since the air-fuel ratio feedback is effected on the basis of the lean mixture signal, problems may occur that the fuel becomes over-rich, exhaust of HC, CO increases or the idle stability is adversely affected.

SUMMARY OF THE INVENTION

An object of the invention is to provide an air-fuel ratio control system of an internal combustion engine wherein excessive fuel supply according to the air-fuel ratio feedback control is eliminated by the air-fuel ratio open control, air fuel ratio is stabilized and harmful exhaust is reduced.

Another object of the invention is to provide an air-fuel ratio control system of an internal combustion engine wherein the air-fuel ratio can be controlled well by only performing a simple control.

A further object of the invention is to provide an air-fuel ratio control system of a internal combustion engine, wherein the air-fuel ratio can be controlled to optimum value by the air-fuel ratio feedback control and the air-fuel ratio open control, thereby the air-fuel ratio is stabilized and the idle stability is improved.

Subject-matter of the invention is in an air-fuel ratio control system of an internal combustion engine as shown in a basic constitution diagram of FIG. 1 comprising an air-fuel ratio detecting means M1 for detecting the air-fuel ratio of the internal combustion engine; a running state detecting means M2 for detecting the running state of the internal combustion engine; an air-fuel ratio feedback control means M3 for outputting feedback control signal into aimed air-fuel ratio corresponding to the air-fuel ratio and the running state; a fuel cut control means M4 for outputting an interruption signal to interrupt the fuel supply if the running state satisfies a prescribed fuel cut condition and for outputting a reset signal to reopen the fuel supply if the running state satisfies a prescribed fuel reset condition; and an air-fuel ratio control means M6 for outputting first fuel supply signal to a fuel supply means M5 on the basis of the feedback control signal from the air-fuel ratio feedback control means M3, for interrupting the fuel supply signal to the fuel supply means M5 if the interruption signal is entered from the fuel control means M4, for outputting second fuel supply signal for the air-fuel ratio open control to the fuel supply means M5 on the basis of only the running state into the prescribed air-fuel ratio during a prescribed time from inputting the reset signal, and for outputting the first fuel supply signal again to the fuel supply means M5 after lapse of the prescribed time.

DETAILED DESCRIPTION OF PREFERRED EMBODIMENT

Embodiment of the invention will now be described referring to the accompanying drawings.

Figure 1:
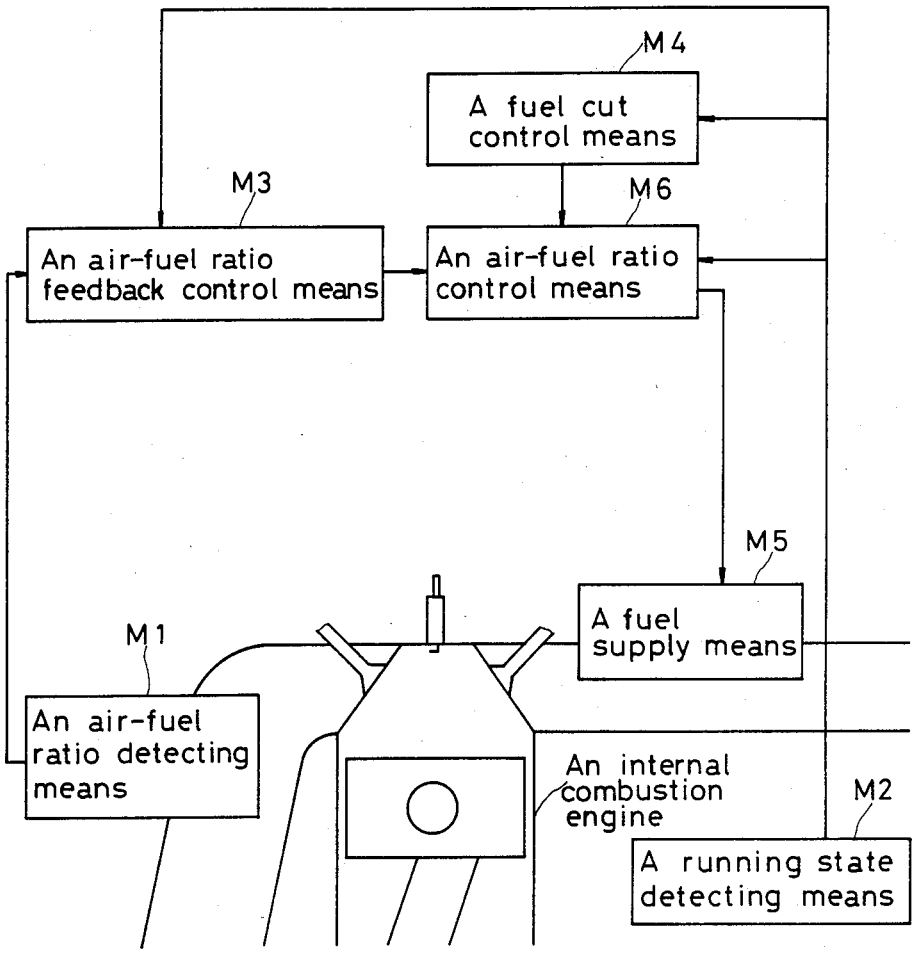
FIG. 1 is a basic constitution diagram of the invention.
Figure 2:
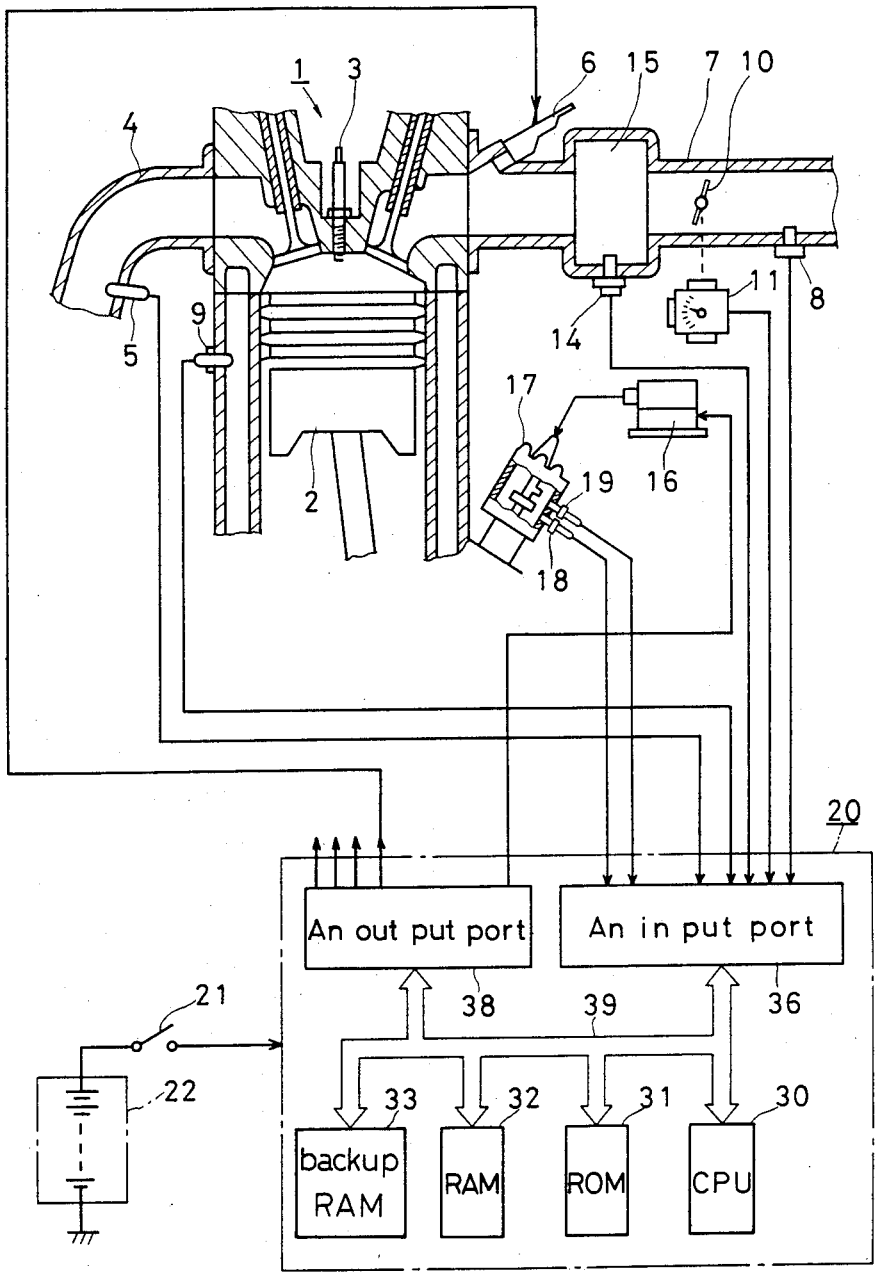
FIG. 2 is a schematic constitution diagram together with a block diagram illustrating an internal combustion engine and a periphery apparatus in an embodiment of the invention.

FIG. 2 is a schematic constitution diagram illustrating an internal combustion engine and a peripheral apparatus thereof in an embodiment of the invention.

In FIG. 2, reference numeral 1 designates an internal combustion engine body, numeral 2 a piston, numeral 3 an ignition plug, numeral 4 an exhaust manifold, numeral 5 an oxygen sensor which is attached to the exhaust manifold 4 and serves as an air-fuel ratio detecting means for detecting residual oxygen content in an exhaust gas in analog notation, numeral 6 a fuel injection valve as a fuel supply means for injecting fuel into an inlet air of the internal combustion engine body 1, numeral 7 an inlet air manifold, numeral 8 an inlet air temperature sensor for detecting temperature of an inlet air introduced in the internal combustion engine body 1, numeral 9 a water temperature sensor for detecting temperature of a cooling water of the internal combustion engine, numeral 10 a throttle valve, numeral 11 a throttle position sensor interlocked with the throttle valve 10 for outputting signal corresponding to opening of the throttle valve 10, and numeral 14 an inlet air pressure sensor as a running state sensor for measuring inlet air pressure in a surge tank 15 to absorb pulsation of the inlet air.

Numeral 16 designates an igniter outputting high voltage required for the ignition, numeral 17 a distributor which is interlocked with a crank shaft (not shown) and distributes and supplies the high voltage generated by the igniter 16 to the ignition plug 3 of each cylinder, numeral 18 a rotation angle sensor which is installed in the distributor 17 and serves as a revolution speed sensor for outputting 24 pulse signals per one revolution of the distributor 17, i.e. per two revolutions of the crank shaft, numeral 19 a cylinder discrimination sensor for outputting one pulse signal per one revolution of the distributor 17, numeral 20 an electronic control circuit as means for controlling an air-fuel ratio feedback, means for controlling a fuel cut and means for controlling an air-fuel ratio, numeral 21 a key switch, and numeral 22 a battery for supplying power to the electronic control circuit 21 through the key switch 21.

Internal constitution of the electronic control circuit 20 will now be described. In FIG. 2, numeral 30 designates a central processing unit (CPU) where data outputted from sensors are entered and operated according to the control program and processing for the operation control of various devices is performed, numeral 31 a read only memory (ROM) where the control program and the initial data are stored, numeral 32 a random access memory (RAM) where data entered in the electronic control circuit 20 and data required for the operation control are temporarily read and written, numeral 33 a backup random access memory (backup RAM) as non-volatile memory backed up by a battery so that even if the key switch 21 is turned off data required for running of the internal combustion since then are held, numeral 36 an input port for inputting signals from various sensors, numeral 38 an output port for driving the igniter 16 and the fuel injection valves 6 installed in various cylinders, and numeral 39 a common bus to connect the above elements mutually. The input port 36 is composed of an analog input member (not shown) for converting analog signals from the oxygen sensor 5, the inlet air temperature sensor 8, the water temperature sensor 9, the throttle position sensor 11 and the inlet air pressure sensor 14 in A/D conversion and inputting the converted signals, and of a pulse input member (not shown) for inputting pulse signals from the rotation angle sensor 18 and the cylinder discrimination sensor 19. The output port 38 is provided with a counter for setting the fuel injection amount (fuel injection time). If processing for starting the fuel injection is performed by the CPU 30, a drive signal to open the fuel injection valve 6 installed on the cylinder for performing the fuel injection is outputted by time corresponding to the valve which is already calculated on the basis of output of the oxygen sensor 5 and output of the inlet air pressure sensor 14 and set to the counter so as to perform the feedback control to the aimed air-fuel ratio, thereby the fuel injection amount is controlled.

If the fully closed state of the throttle valve 10 according to output of the throttle position sensor 11 and the revolution speed of the internal combustion engine detected by the rotation angle sensor 18 satisfy the prescribed condition, an interruption signal for interrupting the fuel supply to the fuel injection valve 6 is outputted from the output port 38. If the above-mentioned condition is not satisfied, a reset signal for reopening the fuel supply is outputted from the output port 38 to the fuel injection valve 6. Thus the fuel cut is executed only on the prescribed fuel cut condition.

In a similar manner, on the basis of the engine revolution speed, the inlet air pressure or the like, for example, using the data map in the ROM 31, the optimum ignition timing is calculated. On the basis of the calculated value, the ignition timing signal is transmitted to the igniter 16, and thereby the ignition timing is controlled corresponding to the running state of the internal combustion engine, such as the revolution speed thereof.

Figure 3:
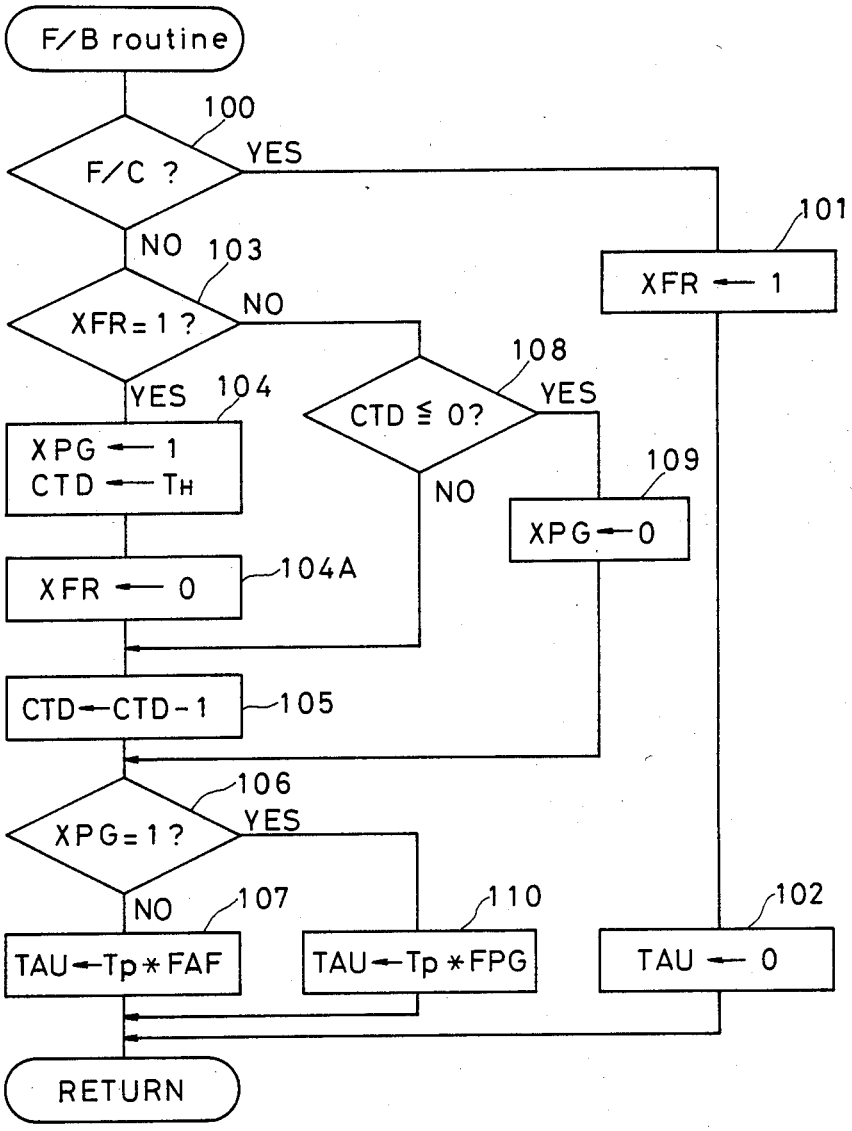
FIG. 3 is a flow chart of air-fuel ratio control subroutine.

Control executed by the electronic control circuit 20 of the embodiment will now be described according to a flow chart of air-fuel ratio control subroutine (F/B routine) shown in FIG. 3. The subroutine is executed in synchronization with a prescribed crank angle, for example, every 30° of the crank angle. Both the flag XFR and the flag XPG are initialized and disabled. In the step 100 of FIG. 3, decision is made regarding whether or not the fuel cut (F/C) state exists now, that is, whether or not the interruption signal is outputted and the fuel injection valve is in the fuel injection interruption state.

This F/C state is executed, for example, when the throttle valve is fully closed and the actual revolution number of internal combustion engine exceeds that of fuel cut being executed (Nc), which is decided by the water temperature of the engine. When the throttle valve is in ay state except the full close, or when the actual revolution number of the internal combustion engine is less than that of F/C being reset NA (<Nc), which is decided by water temperature of the engine, the F/C state is stopped.

In the step 101, the flag XFR indicating whether or not the fuel reset state exists is enabled. In the step 102, the fuel injection time TAU is set to "0" and the fuel injection interruption is executed. In the step 103, decision is made regarding whether or not the flag XFR is at "1". In the step 104, the flag XPG indicating the air-fuel ratio open control is enabled and at the same time the setting time $T_H$(sec) preferably in the range of 0.1–0.5 sec, e.g. 0.2 sec is set to the timer counter CTD. In the step 104A, the flag XFR is disabled. In the step 105, the counter CTD is decremented. In the step 106, a decision is made regarding whether or not the flag XPG is enabled. In the step 107, the basic fuel injection time $T_P$ estimated from the inlet air pressure or the like is multiplied by the air-fuel ratio feedback control correction factor FAF estimated on the basis of an integration value of output of the oxygen sensor 5 thereby the fuel injection time TAU is calculated and the first fuel supply signal corresponding to the TAU is outputted from the output port 38 to the fuel injection valve 6. In the step 108, a decision is made regarding whether or not the timer counter CTD is at "0" or less. In the step 109, the flag XPG is disabled. In the step 110, the basic fuel injection time $T_P$ is multiplied by the air-fuel ratio open control correction factor FPG (constant value) thereby the fuel injection time TAU is calculated and the second fuel supply signal corresponding to the TAU is outputted from the output port 38 to the fuel injection valve 6.

If the processing is started in the above constitution, the step 100 determines "NO", then the step 103 determines "NO" because the flag XFR is disabled. The step 108 determines "YES" because the counter CTD is at "0". In the step 109, the flag XPG is disabled and the process is jumped to the step 106. The step 106 determines "NO" because the flag XPG is disabled. In the step 107, the air-fuel ratio feedback control is executed so that the process gets out of the subroutine.

During the F/C execution, the step 100 determines "YES", and in the step 101 the flag XFR is enabled. In the step 102, the fuel cut is executed thus the process gets out of the subroutine.

If the prescribed reset condition is satisfied, the step 100 determines "NO" and the process is jumped to the step 103. The step 103 determines "YES" because the flag XFR is enabled already in the step 101. The process is jumped to the step 104 and the flag XPG is enabled and the $T_H$ is set to the timer counter CTD. In the step 104A, the flag XFR is disabled. In the step 105, the timer counter CTD is decremented. The step 106 determines "YES" because the flag XPG is enabled already in the step 104. The process is jumped to the step 110 where the fuel injection time TAU for the air-fuel ratio open control is calculated and the second fuel supply signal is outputted to the fuel injection valve 6 thus the process gets out of the subroutine.

Above processing is executed at the F/C reset time. If the next F/B routine is started, the step 100 determines "NO". The step 103 determines "NO" because the flag XFR is disabled already in the step 104A of the previous processing. The process is jumped to the step 108 where decision is made "NO" because the timer counter CTD is not "0" or less. The process is jumped to the step 105 where the timer counter CTD is decremented. And then the step 106 and the step 110 are executed in sequence thus the process gets out of the subroutine.

As the above-mentioned processing is repeated and the timer counter CTD is decremented in the step 105, the timer counter CTD becomes "0" or less and therefore the step 108 determines "YES". The process is jumped to the step 109 where the flag XPG is disabled and the processing to change the air-fuel ratio open control into the air-fuel ratio feedback control is performed. The step 16 determines "NO", and in the step 107 the fuel injection time TAU for the air-fuel ratio feedback control is calculated and the first fuel supply signal is outputted to the fuel injection valve 6 thus the process gets out of the subroutine.

In addition, processing the step 110 corresponds to air-fuel ratio feedback control means, series of processings in the steps 100–101–102 to fuel cut control means, and series of processings in the steps 100–103–104–104A–105–106–110, the steps 100–103–108–105–106–110 or the steps 100–103–108–109–106–107 to air-fuel ratio control means.

Figure 4:
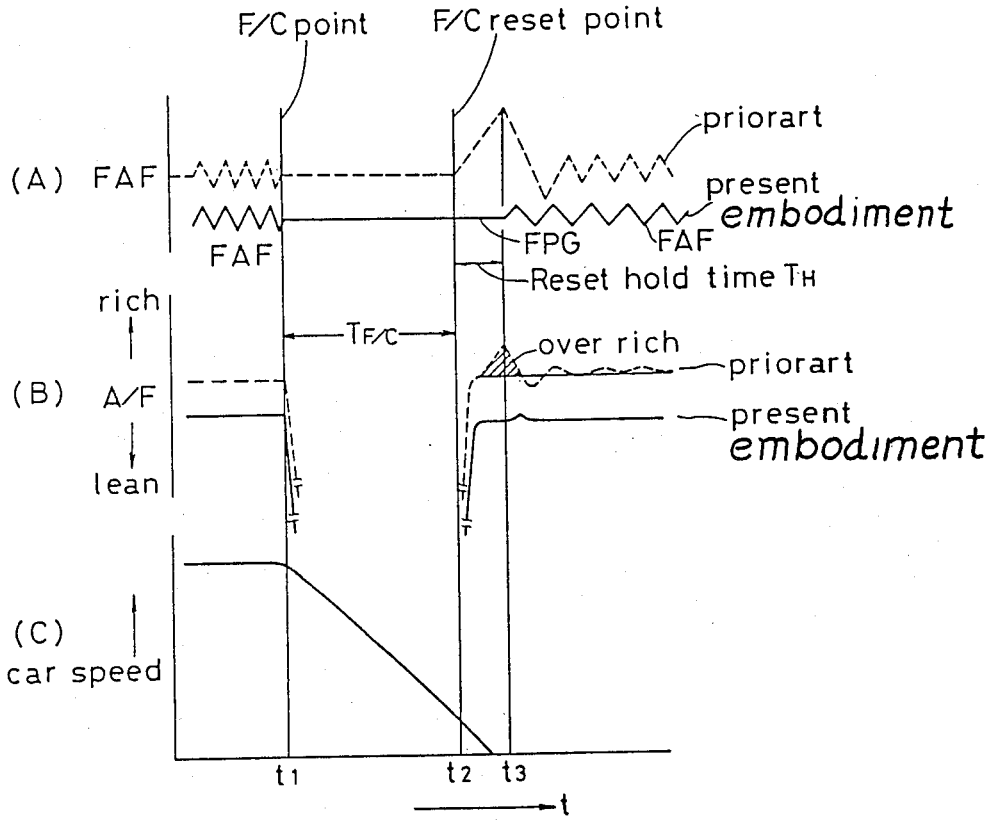
FIGS. 4(A–C) show a graph of air-fuel ratio feedback control correction factor FAF (or air-fuel ratio open control correction factor FPG), air-fuel ratio A/F and vehicle speed with respect to time t.
Figure 5:
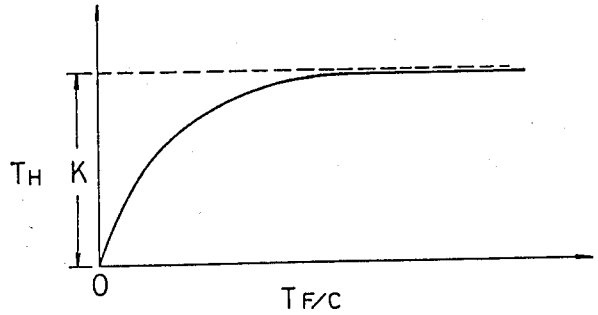
FIG. 5 is a graph illustrating variation of a reset hold time $T_H$ depending on a fuel cut time $T_F/C$.

FIG. 4 shows results of the above-mentioned processing. FIG. 4(A) is a graph illustrating a correlation of FAF or FPG to time t, FIG. 4(B) is a graph illustrating correlation of air-fuel ratio A/F to time T, and FIG. 4(C) is a graph illustrating correlation of vehicle speed to time t. In the figure, the air-fuel ratio feedback control is performed before the time $t_1$ and after the time $t_3$, the fuel cut is performed at the time $t_1-t_2$, and the air-fuel ratio open control is performed at the time $t_2-t_3$. In FIGS. 4–5, the broken line represent the prior art, and the solid lines represent the embodiment. An interval between $t_1-t_2$ is called fuel cut time $T_{F/C}$, and an interval between $t_2-t_3$ is called reset hold time $T_H$. In the prior art, since the feedback is started just after the fuel cut reset, detection of the oxygen sensor 5 is delayed by the gas delay time of the system and therefore the control becomes inclined to the rich mixture side. Consequently, FAF increases rapidly during the reset hold time $T_H$ as seen in FIG. 4(A), and A/F becomes overrich as seen in FIG. 4(B). In comparison to the prior art represented by broken line, FPG is constant in the embodiment represented by the solid line and therefore the overrich state of A/F is suppressed, as seen in FIG. 4(B).

The hold time $T_H$ may be controlled to vary depending on length of the fuel cut time $T_{F/C}$ as shown in FIG. 5. For example, the relation may be specified by the formula $$T_H = K\left(1 - \exp\frac{-T_{F/C}}{\tau}\right)$$

where K: constant, $\tau$: time constant. In the formula, if the $T_{F/C}$ is short, the $T_H$ becomes short; if the $T_{F/C}$ is long, the $T_H$ becomes long. The relation may be specified also by a linear function.

$$T_H = aT_{F/C} + b$$

where a, b: constant, $T_H$ becomes constant after $T_{F/C}$ $T_o$. This is because if the $T_{F/C}$ is short, variation of A/F caused by fuel adhered to the air inlet pipe is small and therefore the $T_H$ may be short. On the contrary, if the $T_{F/C}$ is long, non-combustion gas is little and therefore the $T_H$ must be lengthened and the A/F may be stabilized. If the $T_{F/C}$ becomes longer than a certain value, the non-combustion gas does not exist and therefore the $T_H$ may be made constant.

According to the embodiment as above described, the air-fuel ratio feedback open control is performed during $T_H$ sec from the F/C reset time, and the air-fuel ratio feedback control is again performed after lapse of the $T_H$. Consequently, the invention has the following effects.

(1) Overrich state caused by the air-fuel ratio feedback control is eliminated and the air-fuel ratio is stabilized and harmful exhaust gases such as HC, CO, $NO_x$ are reduced.

(2) Simple control using the existing system can be performed without performing special signal inputting or outputting.

(3) Since the optimum control of the air-fuel ratio can be performed, the air-fuel ratio is stabilized and the idle stability is improved.

In addition, the air-fuel ratio open control correction factor FPG may be specified by linear expression of the revolution speed of the internal combustion engine or by mapped value of the revolution speed of the internal combustion engine and Q/N (ratio of the inlet air amount to the revolution speed of the internal combustion engine). This is because the air-fuel ratio is controlled more precisely.

Although the invention has been described in its preferred embodiments, it is understood that the invention is not limited to the specific embodiments but widely different embodiments may be made without departing from the spirit and scope thereof.

What is claimed is:

1. An air-fuel ratio control system of an internal combustion engine which includes means for supplying fuel to the engine, comprising:

(A) air-fuel ratio detecting means for detecting an air-fuel ratio of the internal combustion engine;

(b) running state detecting means for detecting a running state of the internal combustion engine;

(c) air fuel ratio feedback control means for outputting a feedback control signal which will adjust the air-fuel ratio toward an aimed air-fuel ratio corresponding to the detected air-fuel ratio and the detected running state;

(d) fuel cut controlling means for outputting an interruption signal to interrupt a fuel supply to the internal combustion engine when the running state satisfies a prescribed fuel cut condition, and for outputting a reset signal to enable the fuel supply when the running state satisfies a prescribed fuel reset condition; and (e) air-fuel ratio control means for: (1) outputting a first supply signal to the fuel supply means on the basis of the feedback control signal from the air-fuel ratio feedback control means, (2) interrupting the first fuel supply signal to the fuel supply means when the interruption signal is output from said fuel cut controlling means, (3) determining a prescribed time $T_H$ based on engine parameters, said prescribed time substantially corresponding to an amount of time which is necessary for gas to reach said air fuel ratio determining means after the outputting of said reset signal (4) outputting a second fuel supply signal to the fuel supply means on the basis of an open control of the fuel supply means during said prescribed time $T_H$ from the outputting of the reset signal, and (5) outputting the first fuel supply signal again to the fuel supply means after a lapse of prescribed time $T_H$.

2. An air-fuel ratio control system of an internal combustion engine as set forth in claim 1, wherein said air-fuel ratio detecting means is an oxygen sensor, and said running state detecting means is one of: (a) an inlet air pressure sensor and (b) an air flow meter and a revolution speed sensor.

3. An air-fuel ratio control system of an internal combustion engine as set forth in claim 1, wherein the prescribed time $T_H$ of the air-fuel ratio open control is set to be in the range between 0.1 and 0.5 sec.

4. An air-fuel ratio control system of an internal combustion engine as set forth in claim 1, wherein the prescribed time $T_H$ of the air-fuel ratio open control is controlled to vary depending on a time of fuel cut $T_{F/C}$, from said interruption signal until said reset signal, such that if the time $T_{F/C}$ is long, the prescribed time $T_H$ becomes long.

5. An air-fuel ratio control system of an internal combustion engine as set forth in claim 1, wherein the fuel reset condition is specified by the revolution speed of the engine.

6. An air-fuel ratio control system of an internal combustion engine as set forth in claim 1, wherein said air fuel ratio control means generates the first fuel supply signal on the basis of a basic fuel injection time $T_P$ specified by the detected running state, multiplied by a feedback control factor FAF, specified depending on the detected air-fuel ratio.

7. An air-fuel ratio control system of an internal combustion engine as set forth in claim 1, wherein said air-fuel ratio control means generates the second fuel supply signal on the basis of the basic fuel injection time $T_P$ specified by the detected running state, multiplied by a definite air-fuel ratio open control correction factor FPG.

8. An apparatus as in claim 4 wherein the relation between $T_H$ and $T_{F/C}$ is such that a function formed between $T_H$ and $T_{F/C}$ is a curve with a decreasing slope which approaches a saturated limit.

9. An apparatus as in claim 8 wherein said second fuel supply signal is based on an air-fuel ratio open control correction factor, which is unrelated to said feedback control signal from said air-fuel ratio feedback control means.

10. An apparatus as in claim 4 wherein said prescribed time $T_H$ is determined exponentially according to the formula:

$$T_H = K\left(1 - \exp\frac{-T_{F/C}}{\tau}\right)$$

where K is a constant and $\tau$ is a time constant, and T is time.

11. An apparatus as in claim 9 wherein said air-fuel ratio open control correction factor is a function of engine speed.

12. An apparatus as in claim 9 wherein said air-fuel ratio open control correction factor is a function of engine speed and an engine load Q/N.

13. An apparatus for controlling an air-fuel ratio in an internal combustion engine, comprising:

means for supplying fuel to the engine;

air-fuel feedback control means for providing a feedback control signal based on engine parameters;

open loop feedback control means for providing an open loop control signal;

fuel cut control means for providing a fuel cut control signal to interrupt fuel supply by said fuel supply means when said engine parameters satisfy a first predetermined relationship, and for resetting said fuel cut control signal when said engine parameters satisfy a second predetermined relationship; and controlling means, coupled to said fuel cut control signal, said feedback control signal, said open loop control signal, and said fuel supplying means for controlling an operation of said fuel supplying means and for: (1) outputting a first fuel supply sgnal to said fuel supply means based on said feedback control signal when said fuel cut control signal is not being output from said fuel cut control means; (2) interrupting the operation of said fuel supplying means when said fuel cut control signal is being output; (3) determining an amount of fuel cut time during which said fuel cut control signal is being output; (4) determining a hold time as a function of said determined amount of fuel cut time, said hold time substantially corresponding to an amount of time which is necessary for gas to reach said air-fuel feedback control means after a termination of said fuel cut control signal; (5) controlling said fuel supplying means in accordance with said open loop control signal during a period of time corresponding to an elapse of said hold time after the termination of said fuel cut control signal; and (6) controlling said fuel supplying means in accordance with said feedback control signal at the termination of said hold time.

14. An apparatus as in claim 13 wherein said hold time is determined exponentially according to the formula:

$$T_H = K\left(1 - \exp\frac{-T_{F/C}}{\tau}\right)$$

where $T_H$=hold time, K is a constant, $\tau$ is a time constant and T is time.

15. An apparatus as in claim 13 wherein said open loop control signal is a function of engine speed.

16. An apparatus as in claim 13 wherein said open loop control signal is a function of engine speed and engine load.

17. A method for controlling an air-fuel ratio in an internal combustion engine, comprising the steps of:

providing a feedback control signal based on engine parameters including a composition of combustion gas;

providing an open loop control signal;

providing a fuel cut control signal to interrupt a fuel supply by said fuel supplying means when engine parameters satisfy a first predetermined relationship;

resetting said fuel cut control signal when said engine parameters satisfy a second predetermined relationship;

outputting a first supply signal to control fuel supply based on said feedback control signal when said fuel cut control signal is not being output;

interrupting the first fuel supply signal when said fuel cut control signal is being output;

determining an amount of fuel cut time during which said fuel cut control signal is output;

determining a hold time as a function of said determined amount of fuel cut time, said hold time substantially corresponding to an amount of time which is necessary for combustion gas to be included in said feedback control signal after a termination of said fuel cut control signal;

controlling said fuel supplying in accordance with said open loop control signal during a period of time corresponding to an elapse of said hold time after the termination of said fuel cut control signal; and controlling said fuel supplying means in accordance with said feedback control signal at the termination of said hold time.

* * * * *